US010400985B2

(12) United States Patent
Streppel et al.

(10) Patent No.: US 10,400,985 B2
(45) Date of Patent: Sep. 3, 2019

(54) LIGHTING DEVICE

(71) Applicant: OSRAM GmbH, Munich (DE)

(72) Inventors: Henrike Streppel, Regensburg (DE); Klaus Eckert, Herbrechtingen (DE); Carolin Muehlbauer, Laub (DE)

(73) Assignee: LEDVANCE GMBH, Garching Bei München (DE)

( * ) Notice: Subject to any disclaimer, the term of this patent is extended or adjusted under 35 U.S.C. 154(b) by 686 days.

(21) Appl. No.: 14/097,278

(22) Filed: Dec. 5, 2013

(65) Prior Publication Data

US 2014/0168968 A1 Jun. 19, 2014

(30) Foreign Application Priority Data

Dec. 19, 2012 (DE) ..... 10 2012 223 860

(51) Int. Cl.
*F21V 5/04* (2006.01)
*F21V 7/00* (2006.01)
(Continued)

(52) U.S. Cl.
CPC ..... *F21V 5/04* (2013.01); *F21K 9/233* (2016.08); *F21V 7/0091* (2013.01); *F21V 17/16* (2013.01);
(Continued)

(58) Field of Classification Search
CPC ..... F21V 17/16; F21V 17/164; F21V 17/162; F21V 17/166; F21V 17/168; F21V 19/0035; F21V 17/005; F21V 19/004; F21V 5/04; F21V 7/0091; F21V 19/0045; F21V 17/06; F21V 17/10; F21V 17/104; F21V 17/107; F21K 9/37; F21K 9/233; F21L 15/06; F21L 15/08; G02B 7/022; G02B 7/026
(Continued)

(56) References Cited

U.S. PATENT DOCUMENTS 1,582,138 A 4/1926 Heines
4,941,070 A * 7/1990 Ogawa ..... G03B 15/03 313/594
(Continued)

FOREIGN PATENT DOCUMENTS

CN 102410447 A 4/2012
CN 102667322 A 9/2012
(Continued)

OTHER PUBLICATIONS

International Search Report for PCT/EP2007/059608; dated Nov. 2, 2007; 1 page.
(Continued)

*Primary Examiner* — Bryon T Gyllstrom
*Assistant Examiner* — James M Endo
(74) *Attorney, Agent, or Firm* — Hayes Soloway PC

(57) ABSTRACT

In various embodiments, a lighting device is provided. The lighting device includes an optical unit having at least one optical element, which optical unit is fastened to the lighting device by means of at least one fastening region; wherein the optical unit is fastened with a force fit in at least one direction; wherein the at least one fastening region is formed as a spring element; and wherein the optical unit can be moved through the at least one fastening region in the direction of the force-fit fastening.

20 Claims, 3 Drawing Sheets

(51) Int. Cl.
*F21K 9/233* (2016.01)
*F21V 17/16* (2006.01)
*F21V 17/06* (2006.01)
*F21Y 115/10* (2016.01)

(52) U.S. Cl.
CPC ..... *F21V 17/06* (2013.01); *F21V 17/162* (2013.01); *F21V 17/164* (2013.01); *F21Y 2115/10* (2016.08)

(58) Field of Classification Search
USPC ..... 362/306, 455, 374, 375, 186, 438, 437, 362/439; 359/827, 830; 248/346.04, 248/596, 613, 612, 346.5; 403/330, 111, 403/120, 336, 338
See application file for complete search history.

(56) References Cited

U.S. PATENT DOCUMENTS 5,299,066 A * 3/1994 Rombult ..... F21V 17/164 359/815
6,561,690 B2 * 5/2003 Balestriero ..... F21V 29/87 362/555
6,819,506 B1 * 11/2004 Taylor ..... F21L 4/005 359/726
2002/0089854 A1 * 7/2002 Liu ..... A63H 3/006 362/311.06
2004/0041984 A1 * 3/2004 Tani ..... F21V 7/0091 353/20
2004/0264196 A1 * 12/2004 Shu ..... F21K 9/137 362/294
2006/0044806 A1 * 3/2006 Abramov ..... F21V 5/007 362/337
2006/0291206 A1 * 12/2006 Angelini ..... F21V 5/04 362/244
2006/0291245 A1 * 12/2006 Shimada ..... F21V 5/04 362/612
2007/0133209 A1 * 6/2007 Wang ..... F21K 9/137 362/294
2007/0183154 A1 * 8/2007 Robson ..... F21V 3/04 362/267
2007/0230177 A1 10/2007 Suzuki
2008/0123341 A1 * 5/2008 Chiu ..... F21K 9/233 362/294
2008/0143259 A1 * 6/2008 Sibout ..... F21V 21/30 315/78
2010/0002450 A1 1/2010 Pachler et al.
2011/0063849 A1 * 3/2011 Alexander ..... F21S 48/328 362/294
2011/0110097 A1 * 5/2011 Fu ..... F21V 5/04 362/296.01
2011/0134634 A1 * 6/2011 Gingrich, III ..... F21V 15/01 362/231
2011/0199773 A1 8/2011 Bizzotto et al.
2011/0273892 A1 * 11/2011 Mostoller ..... F21V 17/06 362/311.01
2012/0063143 A1 * 3/2012 Park ..... F21V 14/06 362/277
2012/0074827 A1 3/2012 Hsieh et al.
2012/0147608 A1 * 6/2012 Kawagoe ..... F21V 5/007 362/294
2012/0187836 A1 * 7/2012 Hashimoto ..... F21V 5/04 315/51
2012/0224381 A1 * 9/2012 Hashimoto ..... F21V 3/0436 362/382
2012/0236565 A1 * 9/2012 Wu ..... F21K 9/137 362/294
2012/0281418 A1 11/2012 Eckert et al.

FOREIGN PATENT DOCUMENTS

DE 20311557 U1 10/2003
EP 1586810 A3 11/2006
JP S5887503 A * 5/1983
WO 2005015077 A1 2/2005
WO 2006003569 A1 1/2006
WO 2008031860 A1 3/2008

OTHER PUBLICATIONS

Chinese Office Action based on application No. 2013106847375 (6 pages and 6 pages of English translation) dated Sep. 2, 2016 (Reference Purpose Only).

* cited by examiner

Fig.3
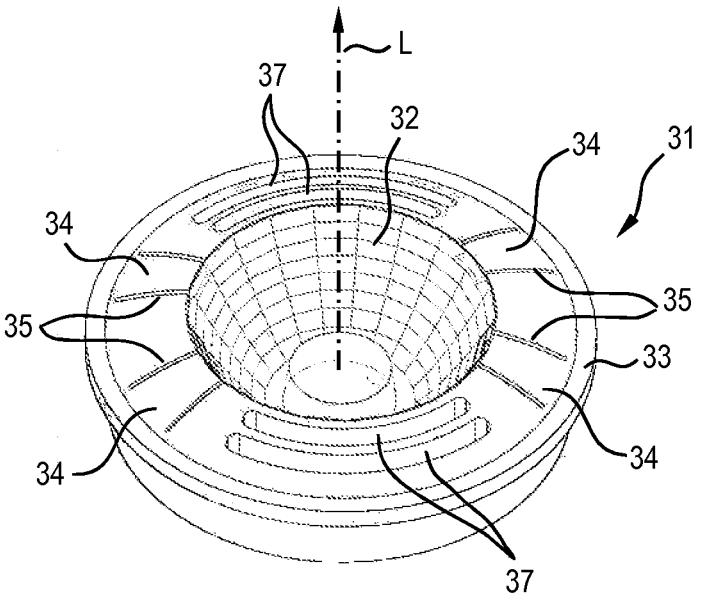
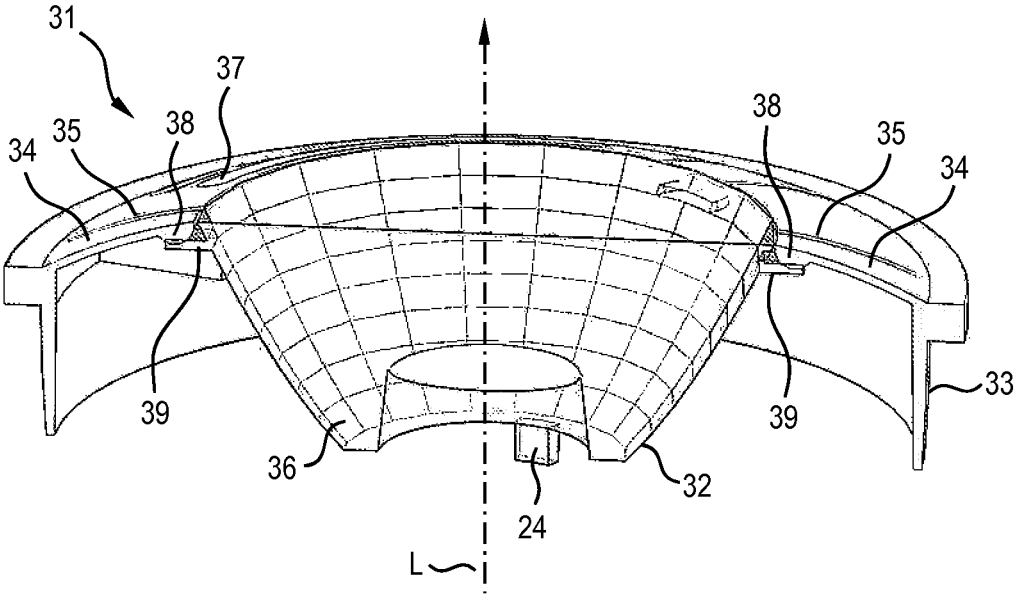
Fig.4

LIGHTING DEVICE

CROSS-REFERENCE TO RELATED APPLICATION

This application claims priority to German Patent Application Serial No. 10 2012 223 860.3, which was filed Dec. 19, 2012, and is incorporated herein by reference in its entirety.

TECHNICAL FIELD

Various embodiments relate generally to a lighting device including an optical unit having at least one optical element, which optical unit is fastened to the lighting device by means of at least one fastening region. Various embodiments may be used e.g. for semiconductor lighting devices, e.g. retrofit lamps.

BACKGROUND

Light emitting diode (LED) lamps which include one or more light-emitting diodes (LEDs) as light sources are known, with an optical element, for example a lens or a reflector, being arranged downstream of the LEDs. The optical element is typically fastened with a form fit, for example by latching, and/or a material fit, for example by adhesive bonding, via at least one fastening region. In order to compensate for assembly defects or play, in the case of a form-fit connection it is known to equip the optical element additionally with spring elements. In this way, movement of the optical element is possible for typically short distances within the narrow limits dictated by the form-fit connection. Nevertheless, the need to adapt the optical element accurately for assembly remains. Furthermore, positioning or alignment defects of the fastening element holding the optical element with a form fit cannot expediently be compensated for.

SUMMARY

In various embodiments, a lighting device is provided. The lighting device includes an optical unit having at least one optical element, which optical unit is fastened to the lighting device by means of at least one fastening region; wherein the optical unit is fastened with a force fit in at least one direction; wherein the at least one fastening region is formed as a spring element; and wherein the optical unit can be moved through the at least one fastening region in the direction of the force-fit fastening.

BRIEF DESCRIPTION OF THE DRAWINGS

In the drawings, like reference characters generally refer to the same parts throughout the different views. The drawings are not necessarily to scale, emphasis instead generally being placed upon illustrating the principles of the invention. In the following description, various embodiments of the invention are described with reference to the following drawings, in which:

FIG. 3 shows an optical unit with a cover of a lighting device according to various embodiments, in a view obliquely from above; and FIG. 4 shows the elements of FIG. 3 as a sectional representation in oblique view.

DESCRIPTION

Figure 1:
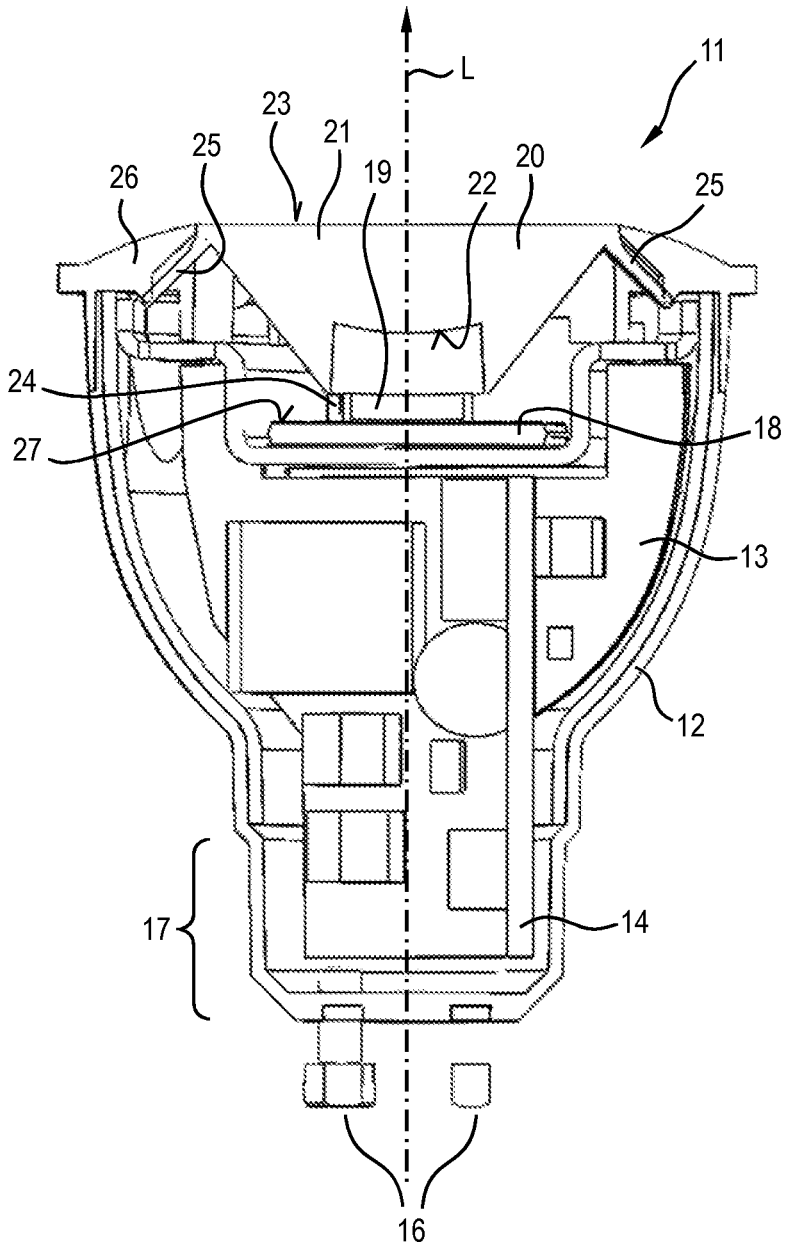
FIG. 1 shows a lighting device according to various embodiments as a sectional representation in side view.
Figure 2:
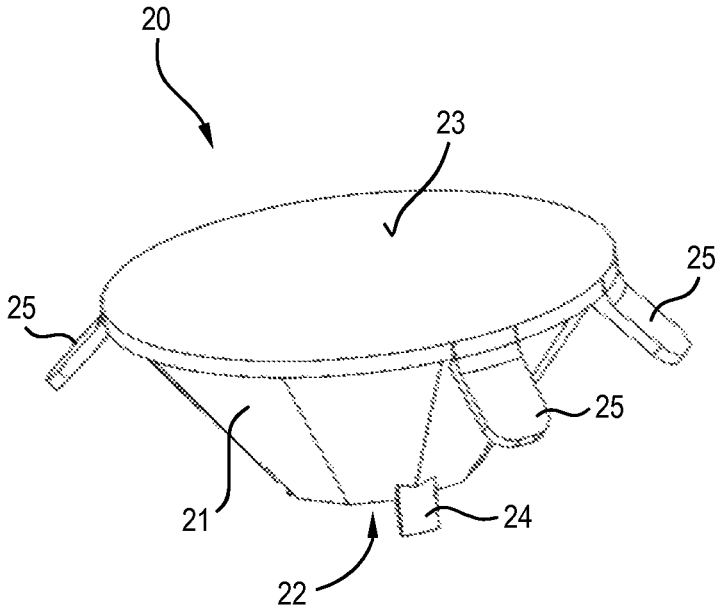
FIG. 2 shows the optical unit of the lighting device according to various embodiments.

The following detailed description refers to the accompanying drawings that show, by way of illustration, specific details and embodiments in which the invention may be practiced.

The word "exemplary" is used herein to mean "serving as an example, instance, or illustration". Any embodiment or design described herein as "exemplary" is not necessarily to be construed as preferred or advantageous over other embodiments or designs.

The word "over" used with regards to a deposited material formed "over" a side or surface, may be used herein to mean that the deposited material may be formed "directly on", e.g. in direct contact with, the implied side or surface. The word "over" used with regards to a deposited material formed "over" a side or surface, may be used herein to mean that the deposited material may be formed "indirectly on" the implied side or surface with one or more additional layers being arranged between the implied side or surface and the deposited material.

Various embodiments at least partially overcome the disadvantages of the prior art and, in particular, to provide a possibility of simplified alignment of an optical element of a lighting device.

Various embodiments provide a lighting device including an optical unit having at least one optical element, which optical unit is fastened to the lighting device by means of at least one fastening region, wherein the optical unit is fastened with a force fit in at least one direction, the at least one fastening region is formed as a spring element and the optical unit can be moved by the at least one spring element in the direction of the force-fit fastening.

By virtue of the at least one spring element, the at least one optical unit can thus be moved in a direction in which it is held "only" with a force fit, if at least one spring element exerts a force in this direction, this force exceeding the force necessary for the force fit. An optical unit which is not correctly positioned can thus be displaced into a desired position by the at least one spring element. This in turn allows self-adjustment of the optical unit by the lighting device, without external adjustment having to be carried out.

The lighting device may be a lamp, a light, a lighting system or a lighting module.

The fastening region may, for example, be a region of the optical unit or of a part of the lighting device holding the optical unit, for example a tab or pin, provided for fastening the optical unit.

That the optical unit is fastened with a force fit in at least one direction means, for example, that the optical unit can be displaced through a significant distance in this direction by exerting a correspondingly directed force, this distance being e.g. longer than typical plays of a form-fit connection.

The optical unit may include one or more optical elements. If the optical unit includes a plurality of optical elements, the optical unit may have a holder for these individual optical elements. Alternatively, the optical elements may be integrally connected to one another, for example by production with an injection-molding method. The plurality of optical elements may be arranged optically in parallel and/or series.

The optical unit is, for example, arranged downstream of at least one light source of the lighting device. The at least one light source has, for example, at least one semiconductor light source. In various embodiments, the at least one semiconductor light source includes at least one light-emitting diode. When there are a plurality of light-emitting diodes, these may shine in the same color or different colors. A color may be monochromatic (for example red, green, blue, etc.) or polychromatic (for example white). The light emitted by the at least one light-emitting diode may also be infrared light (IR-LED) or ultraviolet light (UV-LED). A plurality of light-emitting diodes may generate mixed light, for example white mixed light. The at least one light-emitting diode may contain at least one wavelength-converting luminescent material (conversion LED). The luminescent material may, alternatively or in addition, be arranged remotely from the light-emitting diode ("remote phosphor"). The at least one light-emitting diode may be in the form of at least one individually packaged light-emitting diode or in the form of at least one LED chip. A plurality of LED chips may be mounted on a common substrate ("sub-mount"). The at least one light-emitting diode may be equipped with at least one optical unit of its own and/or a common optical unit for beam guiding, for example at least one Fresnel lens, collimator, etc. Instead of or in addition to inorganic light-emitting diodes, for example based on InGaN or AlInGaP, it is generally also possible to use organic LEDs (OLEDs, for example polymer OLEDs). As an alternative, the at least one semiconductor light source may for example include at least one diode laser. The laser may, for example, illuminate at least one remotely arranged conversion region including luminescent material ("LARP": Laser Activated Remote Phosphor).

It is one configuration that the optical unit includes a reflector. The reflector may, for example, be a half-dish reflector.

It is an alternative or additional configuration that the optical unit includes a lens. The lens may in particular be a TIR lens ("Total Internal Reflection"). The TIR lens is an efficient optical element which uses total internal reflection in order to collimate light emitted, for example, by an LED, e.g. in a Lambertian light emission pattern.

It is one refinement that the optical unit includes a non-imaging light transmission element, for example a concentrator, for example a CPC concentrator.

It is yet another configuration that at least one fastening region is formed integrally with the optical unit. To this end, for example, the at least one fastening region may be formed integrally with the optical unit, i.e. it may in particular be a region of the optical unit consisting of the same material. This may, for example, be achieved by economical production methods such as plastic injection molding, glass molding, etc. As an alternative, the at least one fastening region may be produced separately from the at least one optical element, but then have been connected unreleasably thereto, for example by adhesive bonding.

It is also a configuration that at least one fastening region is formed integrally with a holding element for the optical unit. This is advantageous e.g. if the optical unit consists integrally of a brittle material, so that the risk of the fastening regions breaking off is avoided.

It is also a configuration that the lighting device includes a holding element for pressing the optical unit onto a support surface. The support surface provides a form fit perpendicularly to its surface, but not along its support surface. Along its support surface, the optical unit is held with a force fit and can thus be displaced on the support surface, parallel thereto, by corresponding force exertion. The support surface may have a continuous surface or may have recesses. Furthermore, the holding element and the optical unit are connected to one another by means of a plurality of spring elements, which exert forces on the optical unit in different directions along its support surface. If the optical unit is off-centered relative to the holder, some of the spring elements are elastically deformed more strongly than others. The more strongly deformed spring elements then exert a force on the optical unit parallel to the support surface, and displace it in the direction of a less off-centered position. Consequently, self-centering of the optical unit in relation to the holding element can thus be achieved by the support of the holding element. That the spring elements exert forces on the optical unit in different directions along its support surface means, for example, that the spring elements exert forces in different directions parallel to the support surface, so that the optical unit can also be moved two-dimensionally and not just in a straight line. In general, however, merely one-dimensional or straight-line displacement may also be possible.

The spring elements may e.g. be formed as tabs, e.g. as elastically tiltable and/or deformable tabs.

It is one configuration thereof that the holding element is an annular cover. This cover permits secure, comprehensive holding and a large light emission surface. Furthermore, in this way a large variation of the direction of the force exerted on the optical unit parallel to the support surface, i.e. in the direction of the force-fit fastening, is made possible by simple means. A spring element may, for example, be formed by a non-circumferential cut in the cover.

For the case in which at least one spring element is formed integrally with the annular cover, it is one configuration thereof that the cover includes a plurality of spring elements distributed in the circumferential direction for contact with the optical unit. Symmetrical self-adjustment of the optical unit can thus be carried out in a straightforward way. To this end, the cover may e.g. include spring elements arranged equally distributed in the circumferential direction.

For the case in which at least one spring element is formed integrally with the optical unit, it is one configuration thereof that the optical unit includes a plurality of spring elements distributed in the circumferential direction of the cover for contact with the cover. This simplifies replacement of the optical unit, or use of different optical units.

It is furthermore a configuration that the optical unit is seated on a printed circuit board carrying the at least one light source, e.g. semiconductor light source. This permits a particularly compact and economical structure.

It is furthermore a configuration that the lighting device is a retrofit lamp, e.g. an incandescent-lamp retrofit lamp or a halogen-lamp retrofit lamp. A retrofit lamp includes e.g. at least one semiconductor light source, and is used e.g. as a replacement for a conventional lamp. To this end, it has an identical cap and at least approximately an identical outer contour or shape as the conventional lamp to be replaced.

FIG. 1 shows, as a sectional representation in side view, a lighting device 11 in the form of an incandescent-lamp retrofit lamp. The lighting device 11 shows a hollow heat sink 12, which has a driver cavity 13 for accommodating a driver 14. The driver 14 can be supplied with electricity via connections 16, which are part of a rear cap 17, in this case a bi-pin cap. On the front side, the heat sink 12 supports a carrier printed circuit board 18. The carrier printed circuit board 18 bears with its rear side on the heat sink 12 and is equipped on its front side 27 with at least one light-emitting diode 19, which emits into a front half-space.

Arranged downstream of the light-emitting diode 19, there is an optical unit in the form of a TIR lens 20, which lies on the front side before the at least one light-emitting diode 19. The TIR lens 20 is shown in more detail in FIG.

2. The TIR lens 20 includes a light-guiding body 21 having a light entry surface 22 on the lower side and a light exit surface 23 on the upper side. On the lower side, the TIR lens 20 includes a plurality of feet 24 which extend from the body 21 and are supported on the carrier printed circuit board 18. The feet 24 are formed integrally in one piece with the body 21, e.g. produced connected together during the same working step. On an upper or front region of the body 21, lateral fastening regions furthermore extend in the form of spring elements connected integrally in one piece to the body 21, which spring elements are formed as tabs 25 protruding laterally and obliquely backward. The TIR lens 20 consists of a single piece of elastic material, for example plastic, so that the tabs 24 are elastically tiltable and/or even elastically flexible on the body 21.

The TIR lens 20 is placed with its feet 24 freely on the front side 27 of the carrier printed circuit board 18, so that the front side 27 constitutes a support surface for the TIR lens 20. The TIR lens 20 is thus in principle freely displaceable in its movement parallel to the surface of the carrier printed circuit board, here perpendicularly to a longitudinal axis L of the lighting device 11, that is to say it is for example not fixed with a form fit or material fit. Optionally, the at least one light-emitting diode 19 acts as a stop, e.g. for loose positioning of the TIR lens 20 during assembly.

Rather, for its fastening, the TIR lens 20 is pressed onto the carrier printed circuit board 18 by means of a holding element in the form of an annular cover 26, and is subsequently held or fastened there with a force fit in two directions perpendicular to the longitudinal axis L. The TIR lens 20 is thus held with a force fit along the front side 27 of the carrier printed circuit board 18. More precisely, the annular cover 26 presses on the tabs 25 of the TIR lens 20, so that the annular cover 26 is connected to, or in contact with, the TIR lens 20 via the tabs 25.

Because of the pressure of the cover 26, the tabs 25 bend and, owing to their oblique position, exert firstly a force ("normal force") in the direction normal to the front side 27, by which the TIR lens 20 is pressed onto the carrier printed circuit board, as well as secondly a force ("parallel force") parallel to the front side 27. Since the tabs 25 are oriented in the direction of the longitudinal axis L, the respective parallel force points inward toward the longitudinal axis L, although different tabs 25 exert parallel forces in different angularly offset directions along the front side 27 of the carrier printed circuit board 18. The tabs 25 are furthermore arranged rotationally symmetrically in the circumferential direction about the longitudinal axis L, and therefore also in the circumferential direction of the cover 26, so that there is a resting position or reference position of the TIR lens 20, here central with respect to the longitudinal axis L and the at least one light-emitting diode 19, in which the parallel forces of the various tabs 25 cancel one another out.

For assembly, the TIR lens 20 is simply placed onto the front side 27 of the carrier printed circuit board 18 over the at least one light-emitting diode 19. The at least one light-emitting diode 19 in this case acts as a loose stop and prevents excessive lateral movement of the TIR lens 20. The annular cover 26 is subsequently placed on and fastened to the heat sink 12. If the TIR lens 20 is already in its resting or reference position, it is fixed there by the cover 26. If, however, the TIR lens 20 is laterally offset with respect to the cover 26 when the cover 26 is placed on, the tabs 25 are deformed nonuniformly so that the parallel forces no longer cancel one another out. Rather, there is a force difference which presses the TIR lens 20 in the direction of its resting or reference position. Since the TIR lens 20 is held parallel to the front side 27 of the carrier printed circuit board only with a force fit, the parallel force exerted by the tabs 25 can move the TIR lens 20 in the direction of its resting or reference position and therefore bring about self-centering or self-adjustment. Furthermore, tolerance compensation is achieved in this way.

FIG. 3 shows an optical unit 32 with an annular cover 33 of a lighting device 31 in a view from obliquely above. The lighting device 31 may in other regards be constructed in a similar way to the lighting device 11. FIG. 4 shows the optical unit 32 and the annular cover 33 as a sectional representation in oblique view. The optical unit is again, purely by way of example, formed as a TIR lens 32 which can be placed by means of feet 24, for example, on the front side 27 of the carrier printed circuit board 18 above the at least one light-emitting diode 19, as in FIG. 1.

In the lighting device 31, there are now tabs 34 formed as fastening regions no longer on the TIR lens 32 but on the cover 33 used as a holding element. Specifically, the tabs 34 have been produced by cuts 35 in the cover 33. The tabs 34 are thus integrally one-piece regions of the cover 33. This has an advantage e.g. for the case in which the material of the TIR lens 32 is very brittle, for example consisting of glass or PMMA, since tabs applied to the light-guiding body 36 could then break off easily. The cover, and therefore the tabs 34, may conversely consist of less brittle plastic, for example, or of metal.

As in the case of the tabs 25 of the optical unit 20 of the lighting device 11, the tabs 34 are now also oriented in the direction of a longitudinal axis L and are arranged in the circumferential direction of the cover 33, or of the longitudinal axis L, but no longer equally distributed. Rather, in this case there are four tabs 34 which face one another laterally in pairs, the pairs of tabs 34 being arranged at a relatively small angle with respect to one another and ventilation slots 37 being arranged between them over a relatively large angle.

The tabs 34 have contact projections 38 on the lower side for making contact with the optical unit 32, or more precisely a circumferential edge 39 which protrudes laterally from the body 36 and is essentially rigid. By means of this, in a similar way to the lighting device 11, self-centering or self-adjustment and/or tolerance compensation can be brought about since corresponding parallel forces are exerted on the TIR lens 32 by the tabs 34.

Although the invention has been illustrated and described in detail by the exemplary embodiments presented, the invention is not restricted thereto and other variants may be derived therefrom by the person skilled in the art without departing from the protective scope of the invention.

For example, hybrid forms of the lighting devices are also possible, for example with tabs both on the optical unit and on the holding element.

The holding element may generally be in one piece or two pieces.

For instance, instead of or in addition to a TIR lens, it is also possible to use another type of lens or a concentrator.

Furthermore, as an alternative or in addition to the lens, the optical unit may include a reflector.

In general, the optical unit may be a multi-component part, for example having different plastics or plastic and glass as materials. In various embodiments, the light-guiding or optically active body may consist of a different material than the mechanical parts, e.g. the at least one fastening region. In various embodiments, a multi-component plastic part may have been produced by a multi-component injection-molding method.

In general, the terms "one", "a" and "an" may be understood as a singular or plural, particularly in the context of "at least one" or "one or more" etc., so long as this is not explicitly excluded, for example by the expression "precisely one" etc.

Furthermore, a number specification may include precisely the number specified as well as a conventional tolerance range, so long as this is not explicitly excluded.

LIST OF REFERENCES

11 lighting device
12 heat sink
13 driver cavity
14 driver
16 connection
17 cap
18 carrier printed circuit board
19 light-emitting diode
20 TIR lens
21 light-guiding body
22 light entry surface on the lower side
23 light exit surface on the upper side
24 foot
25 tab
26 cover
27 front side
31 lighting device
32 TIR lens
33 cover
34 tab
35 cut
36 body
37 ventilation slot
38 contact projection
39 circumferential edge
L longitudinal axis While the invention has been particularly shown and described with reference to specific embodiments, it should be understood by those skilled in the art that various changes in form and detail may be made therein without departing from the spirit and scope of the invention as defined by the appended claims. The scope of the invention is thus indicated by the appended claims and all changes which come within the meaning and range of equivalency of the claims are therefore intended to be embraced.

What is claimed is:

1. A lighting device comprising:

an optical unit having at least one optical element, wherein the optical unit includes a light-guiding body having:

a light entry surface on a lower side thereof;

a light exit surface on an upper side thereof; and at least one fastening region formed integrally with the optical unit as a plurality of spring elements formed as tabs protruding laterally and obliquely backward from a circumferential outer edge of the optical unit with respect to the upper side of the light-guiding body towards the lower side of the light-guiding body, wherein the optical unit is fastened to the lighting device by means of the at least one fastening region; and a cover configured to cover at least partially a front end of the lighting device so as to contact the plurality of spring elements formed as tabs in a manner that presses the optical unit onto a support surface within the lighting device while allowing the optical unit to be self-adjusting with respect to positioning relative to the support surface;

wherein the optical unit is fastened to the lighting device with a force fit in at least one direction and can be moved through the at least one fastening region in the direction of the force-fit fastening; and wherein the plurality of spring elements formed as tabs is arranged such that the optical unit is self-centering with respect to at least one semiconductor light source of the lighting device.

2. The lighting device of claim 1, wherein the cover is an annular cover having a central aperture that at least partially accommodates the optical unit.

3. The lighting device of claim 1, wherein the plurality of spring elements formed as tabs is distributed in a circumferential direction of the cover for contact with the cover.

4. The lighting device of claim 1, wherein the optical unit comprises a total internal reflection (TIR) lens.

5. The lighting device of claim 1, wherein the lighting device further comprises the at least one semiconductor light source, downstream of which the optical unit is arranged.

6. The lighting device of claim 5, wherein the optical unit is seated on a printed circuit board carrying the at least one semiconductor light source.

7. The lighting device of claim 1, wherein the optical unit is freely displaceable in movement parallel to the support surface.

8. The lighting device of claim 1, wherein the force fit is in two directions perpendicular to the support surface.

9. The lighting device of claim 1, wherein the plurality of spring elements formed as tabs is arranged rotationally symmetrically on the circumferential outer edge of the optical unit.

10. The lighting device of claim 1, further comprising a housing having an open end, wherein:

the optical unit is disposed at least partially within the housing proximate the open end; and the cover, in being configured to cover at least partially the front end of the lighting device, engages the open end of the housing.

11. The lighting device of claim 10, wherein the housing is a hollow heat sink.

12. The lighting device of claim 1, wherein the optical unit includes a foot formed integrally therewith, extending from the lower side of the light-guiding body and supported by the support surface within the lighting device.

13. The lighting device of claim 12, wherein the optical unit is formed from a single piece of elastic material.

14. The lighting device of claim 13, wherein the optical unit is comprised of a plastic.

15. The lighting device of claim 13, wherein the optical unit is formed as a one-piece component.

16. The lighting device of claim 1, wherein:

the optical unit includes a foot formed integrally therewith, extending from the lower side of the light-guiding body and supported by the support surface within the lighting device;

the optical unit is formed as a one-piece component; and the plurality of spring elements formed as tabs is distributed in a circumferential direction of the cover for contact with the cover.

17. A lighting device comprising:

an optical unit having at least one optical element, wherein the optical unit includes a light-guiding body having:

a light entry surface on a lower side thereof;

a light exit surface on an upper side thereof; and at least one fastening region formed integrally with the optical unit as a plurality of spring elements formed as tabs protruding laterally and obliquely backward from a circumferential outer edge of the optical unit with respect to the upper side of the light-guiding body towards the lower side of the light-guiding body, wherein the optical unit is fastened to the lighting device by means of the at least one fastening region;

a cover configured to cover at least partially a front end of the lighting device so as to contact the plurality of spring elements formed as tabs in a manner that presses the optical unit onto a support surface within the lighting device while allowing the optical unit to be self-adjusting with respect to positioning relative to the support surface; and at least one semiconductor light source disposed over the support surface, wherein the plurality of spring elements formed as tabs is arranged such that the optical unit is freely displaceable in movement parallel to the support surface such that the optical unit is self-centering with respect to the at least one semiconductor light source;

wherein the optical unit is fastened to the lighting device with a force fit in at least one direction and can be moved through the at least one fastening region in the direction of the force-fit fastening.

18. The lighting device of claim 17, wherein the optical unit is formed from a single piece of elastic material.

19. The lighting device of claim 17, wherein the optical unit is comprised of a plastic.

20. The lighting device of claim 17, wherein the optical unit is formed as a one-piece component.

* * * * *